US010675503B2

(12) United States Patent
Nakashima et al.

(10) Patent No.: US 10,675,503 B2
(45) Date of Patent: Jun. 9, 2020

(54) WALKING TRAINING APPARATUS AND WALKING TRAINING ASSISTANCE DEVICE

(71) Applicant: TOYOTA JIDOSHA KABUSHIKI KAISHA, Toyota-shi (JP)

(72) Inventors: Issei Nakashima, Toyota (JP); Tomio Ikeda, Toyota (JP); Eiichi Saitoh, Nagoya (JP); Satoshi Hirano, Nagoya (JP); Shigeo Tanabe, Toyoake (JP); Hiroki Tanikawa, Nagoya (JP); Akihito Uno, Kasugai (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 81 days.

(21) Appl. No.: 15/925,831

(22) Filed: Mar. 20, 2018

(65) Prior Publication Data

US 2018/0280756 A1 Oct. 4, 2018

(30) Foreign Application Priority Data

Apr. 4, 2017 (JP) ..... 2017-074710

(51) Int. Cl.
*A63B 21/00* (2006.01)
*A61H 3/00* (2006.01)
(Continued)

(52) U.S. Cl.
CPC ..... *A63B 21/4035* (2015.10); *A45B 9/02* (2013.01); *A61H 3/008* (2013.01);
(Continued)

(58) Field of Classification Search
CPC ... A63B 21/4035; A63B 22/203; A63B 22/02; A63B 22/0235; A63B 21/00178;
(Continued)

(56) References Cited

U.S. PATENT DOCUMENTS 4,342,452 A * 8/1982 Summa ..... A63B 21/0125 482/54
4,529,194 A 7/1985 Haaheim
(Continued)

FOREIGN PATENT DOCUMENTS

CN 201518816 U 7/2010
DE 20 2016 105 512 U1 12/2016
(Continued)

*Primary Examiner* — Andrew S Lo
(74) *Attorney, Agent, or Firm* — Oblon, McClelland, Maier & Neustadt, L.L.P.

(57) ABSTRACT

A walking training apparatus including a treadmill having an infinite orbital rotation type walking surface, the walking training apparatus including: a holding part that a walking trainee holds, in which the holding part is capable of supporting a load applied to the walking surface by the walking trainee and is movable in a direction including a component parallel to the walking surface, is provided. By providing a pseudo stick with the aforementioned structure, the trainee is able to perform training of the upper part of the body that uses the stick in parallel to training of the leg part that uses the treadmill.

7 Claims, 7 Drawing Sheets

(51) Int. Cl.

| | |
|---|---|
| ***A63B 22/02*** | (2006.01) |
| ***A63B 22/20*** | (2006.01) |
| ***A63B 69/00*** | (2006.01) |
| ***A63B 22/00*** | (2006.01) |
| ***A63B 24/00*** | (2006.01) |
| ***A45B 9/02*** | (2006.01) |

(52) U.S. Cl.
CPC ..... *A63B 21/00178* (2013.01); *A63B 22/02* (2013.01); *A63B 22/0235* (2013.01); *A63B 22/203* (2013.01); *A63B 24/0062* (2013.01); *A61H 3/00* (2013.01); *A61H 2201/1638* (2013.01); *A61H 2201/1642* (2013.01); *A61H 2201/5043* (2013.01); *A63B 69/0064* (2013.01); *A63B 2022/0094* (2013.01)

(58) Field of Classification Search
CPC ..... A63B 24/0062; A63B 69/0064; A63B 2022/0094; A45B 9/02; A61H 3/008; A61H 2201/1638; A61H 3/00; A61H 2201/5043; A61H 2201/1642
See application file for complete search history.

(56) References Cited

U.S. PATENT DOCUMENTS 4,890,495 A * 1/1990 Slane ..... A63B 21/154 482/51
5,085,426 A * 2/1992 Wanzer ..... A63B 22/02 482/54
5,499,955 A 3/1996 Becker et al.
6,821,233 B1 * 11/2004 Colombo ..... A61F 5/0102 482/54
6,908,414 B1 * 6/2005 Roadman ..... A63B 22/02 248/200
7,153,240 B1 * 12/2006 Wu ..... A63B 22/0235 482/54
2004/0087418 A1 * 5/2004 Eldridge ..... A63B 21/157 482/54
2004/0204294 A2 * 10/2004 Wilkinson ..... A63B 21/015 482/54
2005/0255971 A1 11/2005 Solomon
2006/0194677 A1 * 8/2006 Whitall ..... A61H 1/0274 482/92
2007/0191197 A1 * 8/2007 Vittone ..... A63B 21/04 482/121
2008/0009396 A1 * 1/2008 von Detten ..... A63B 22/02 482/54
2010/0279827 A1 * 11/2010 Farnsworth ..... A63B 22/02 482/54
2010/0285929 A1 * 11/2010 Bayerlein ..... A61H 1/0237 482/54
2011/0082011 A1 * 4/2011 Ellis ..... A63B 21/0615 482/54
2011/0118090 A1 * 5/2011 Ellis ..... A63B 21/0615 482/54
2011/0312474 A1 * 12/2011 Ellis ..... A63B 21/0615 482/54
2012/0083368 A1 * 4/2012 Ganuza ..... A63B 21/0552 473/446
2013/0184125 A1 * 7/2013 Maguire ..... A63B 22/02 482/54
2014/0087922 A1 * 3/2014 Bayerlein ..... A63B 22/0235 482/54
2015/0087484 A1 * 3/2015 Bayerlein ..... A63B 22/0235 482/54
2015/0335940 A1 11/2015 Johnson
2016/0089563 A1 * 3/2016 Dilli ..... A63B 22/0046 482/54
2016/0346598 A1 * 12/2016 Manzke ..... A63B 22/02
2017/0136289 A1 * 5/2017 Frank ..... A63B 21/4035
2017/0326407 A1 * 11/2017 Johnson ..... A63B 21/4045
2018/0043202 A1 * 2/2018 Johnson ..... A61H 3/04
2018/0093125 A1 * 4/2018 Johnson ..... A63B 21/4027

FOREIGN PATENT DOCUMENTS

JP 11-128390 5/1999
NL 9000946 A 11/1991
WO WO 2014/036981 A1 3/2014

* cited by examiner

WALKING TRAINING APPARATUS AND WALKING TRAINING ASSISTANCE DEVICE

CROSS REFERENCE TO RELATED APPLICATIONS

This application is based upon and claims the benefit of priority from Japanese patent application No. 2017-74710, filed on Apr. 4, 2017, the disclosure of which is incorporated herein in its entirety by reference.

BACKGROUND

The present invention relates to a walking training apparatus and a walking training assistance device.

A walking training apparatus including a treadmill has been known as an apparatus for enabling people who have difficulties in walking recover their walking functions. The treadmill includes a rotation belt, and a trainee walks on the rotation belt in accordance with the rotation of the belt to perform training (see, for example, Japanese Unexamined Patent Application Publication No. H11-128390).

SUMMARY

The trainee performs training by walking on the rotation belt while holding a handrail or the like of the walking training apparatus. As the training proceeds, the trainee stops using the walking training apparatus and moves to walking training on a normal walkway such as a hallway. However, it is quite difficult for the trainee to move from the training using the walking training apparatus in which the trainee does not need to move and there are always places to which the trainee can hold onto to the training on the normal walkway in which the trainee needs to actually move and there is no stable support to which the trainee can apply his/her weight.

The training in the normal walkway is often started by using a stick. However, since there are large differences between the motion of holding a handrail and the motion of using a stick, the trainee often feels anxiety about the motion of using the stick because it is difficult for the trainee to walk while supporting his/her weight by appropriately using the stick. While it is desirable that the trainee also performs training in appropriately using a stick at the stage of training using the walking training apparatus, the trainee cannot put the stick at an appropriate position due to the property of the walking training apparatus that the walking surface is rotated. On the other hand, if the trainee tries to put the stick on the walking surface that is not rotated, the trainee's posture becomes unnatural, which prevents efficient training.

The present invention has been made in order to solve the aforementioned problems and aims to provide a walking training apparatus and a walking training assistance device that cause the walking trainee to smoothly move to the walking training in the normal walkway in a short period of time.

A walking training apparatus according to a first aspect of the present invention is a walking training apparatus including a treadmill having an infinite orbital rotation type walking surface, the walking training apparatus including: a holding part that a walking trainee holds, in which the holding part is capable of supporting a load applied to the walking surface by the walking trainee and is movable in a direction including a component parallel to the walking surface.

According to the aforementioned structure, the walking training apparatus includes a pseudo stick, and the walking trainee is able to perform the training of the upper part of the body that uses a stick in parallel to the training of the leg part that uses the treadmill.

In the aforementioned walking training apparatus, the holding part may be configured in such a way that it is movable along a surface of an imaginary sphere having an imaginary point set to be closer to the walking surface than the holding part is as a center. Further, the position of the holding part can be adjusted in such a way that the imaginary point is positioned on the walking surface. By employing this structure, the trainee is able to feel as if he/she uses the actual stick.

In the aforementioned walking training apparatus, the holding part may be structured in such a way that it can be moved also in a direction perpendicular to a direction including a component parallel to the walking surface. By employing this structure, the trainee is able to feel as if he/she uses the actual stick more strongly. Further, the walking training apparatus may be structured in such a way as to include an elastic member that pulls the holding part back to a reference position of the movement of the holding part, whereby it is possible to secure a higher level of safety. Further, the walking training apparatus may be structured in such a way as to include a regulating member configured to regulate a movable range of the holding part in such a way as to be able to support the load that the walking trainee applies to the moving direction of the holding part. By providing the regulating member as described above, it is possible to add the function of supporting the load with respect to the direction in which the walking trainee falls over, which does not exist as the function of the actual stick. By adding this function, it is expected that the trainee can smoothly move from the training using the walking training apparatus to the training on the normal walkway.

A walking training assistance device according to a second aspect of the present invention is a walking training assistance device mounted on a walking training apparatus including a treadmill having an infinite orbital rotation type walking surface, the device including: a holding part that a walking trainee holds; and a fixing part fixed to the walking training apparatus, in which the holding part is capable of supporting a load applied to the walking surface by the walking trainee and is movable in a direction including a component parallel to the walking surface when the fixing part is fixed to the walking training apparatus.

By mounting the walking training assistance device thus structured on the walking training apparatus as a pseudo stick, the walking trainee is able to perform training of the upper part of his/her body that uses the stick in parallel to the training of the leg part that uses the treadmill.

According to the present invention, the walking trainee is able to smoothly move from the walking training that uses the walking training apparatus to the walking training on the normal walkway in a short period of time.

The above and other objects, features and advantages of the present invention will become more fully understood from the detailed description given hereinbelow and the accompanying drawings which are given by way of illustration only, and thus are not to be considered as limiting the present invention.

DESCRIPTION OF EMBODIMENTS

While the present invention will be explained hereinbelow with reference to an embodiment of the present invention, the invention set forth in claims is not limited to the following embodiment. Further, not all the structures described in the embodiment are necessary as means for solving the problem.

Figure 1:
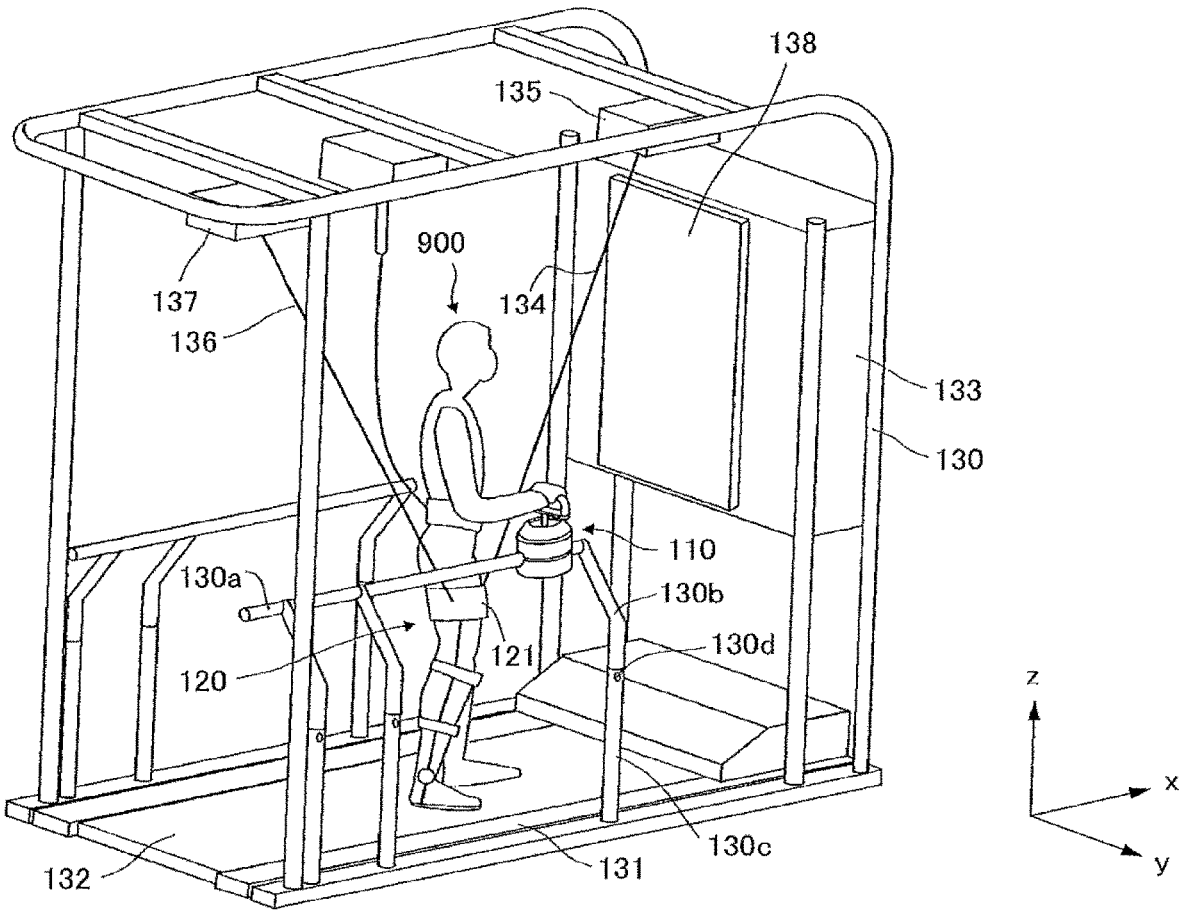
FIG. 1 is a schematic perspective view of a walking training apparatus according to an embodiment.

FIG. 1 is a schematic perspective view of a walking training apparatus 100 according to this embodiment. The walking training apparatus 100 is an apparatus that a trainee 900, who is a disabled person with a disability such as hemiplegia or an elderly person whose leg power has been reduced, uses to perform walking training. The walking training apparatus 100 mainly includes a frame 130, which forms a whole skeleton, a treadmill 131, an assistance stick tool 110, a leg part assistance apparatus 120, and a controller 133.

The frame 130 is installed on the treadmill 131 placed on a floor surface. The treadmill 131 has an infinite orbital rotation type walking surface, and rotates a ring-shaped belt 132 as a walking surface by a motor shown in FIG. 1. The trainee 900 who performs walking training stands on the belt 132 and tries to walk in accordance with the movement of the belt 132.

The frame 130 supports the controller 133 that controls the motor and sensors, a display unit 138 that displays the state of progress of the training and the like. Further, the frame 130 supports pulling parts 135 and 137 that wind and feed wires 134 and 136 near the top of the head of the trainee 900.

The leg part assistance apparatus 120 is mounted on the affected leg of the trainee 900 and assists walking of the trainee 900. The leg part assistance apparatus 120 includes, for example, a motor unit that assists bending motions of the knee joint. The leg part assistance apparatus 120 further detects a load that the sole of the trainee receives and outputs the detected load to the controller 133. The leg part assistance apparatus 120 includes an upper thigh frame 121 to which the respective ends of the wires 134 and 136 are fixed.

The pulling part 135 is provided anterior to the trainee 900, and winds or feeds the wire 134 in response to commands from the controller 133 generated in accordance with the load of the sole. The pulling part 137 is provided posterior to the trainee 900, and, similar to the pulling part 135, winds or feeds the wire 136 in response to commands from the controller 133. By repeating these operations, the pulling parts 135 and 137 assist swinging motions of the trainee 900 by pulling the upper thigh frame 121 up and forward and assist kicking-out motions of the trainee 900 by pulling it up and backward. The controller 133 controls not only the pulling parts 135 and 137 but also the rotational movement of the belt 132, the display of the display unit 138 and the like.

The frame 130 is structured in such a way as to surround the trainee 900 as shown in FIG. 1, and includes an attachment bar 130*a* to which the assistance stick tool 110 is attached. The assistance stick tool 110 is held by the trainee 900, thereby serving as a pseudo stick, as will be described later. Accordingly, the assistance stick tool 110 is mounted on the attachment bar 130*a* so that the trainee 900 can hold the assistance stick tool 110. The attachment bar 130*a* is a stick-shaped frame that is extended along the front-back direction, which is the moving direction of the belt 132, and is an immovable part fixed to the frame 130 in the walking training apparatus 100. The attachment bar 130*a* serves as a handrail that the trainee 900 holds in order to support his/her weight before the trainee 900 starts training using the assistance stick tool 110.

The attachment bar 130*a* is supported by the skeletal frame in such a way that the height of the attachment bar 130*a* can be adjusted in accordance with the body type and the posture of the trainee 900. Specifically, hooks 130*d* are provided in such a way that the positions of adjustment bars 130*b* that support the attachment bar 130*a* can be adjusted in the vertical direction at a plurality of parts with respect to vertical bars 130*c* installed in the skeletal frame. Further, the attachment bar 130*a* has a stick-like shape having a constant diameter in such a way as to be able to adjust the attachment position of the assistance stick tool 110 in the front-back direction. While FIG. 1 shows a state in which the assistance stick tool 110 is mounted on the right attachment bar 130*a* of the trainee 900, the attachment bar 130*a* and the like are provided on the left side as well so that the assistance stick tool 110 can be mounted on the left attachment bar.

As shown in FIG. 1, the plane parallel to the floor surface on which the walking training apparatus 100 is placed is represented by the xy-plane and the moving direction of the belt 132 is represented by the x direction. Further, the vertical direction which is vertical to the floor surface is represented by a z axis. In the following description, in each of the drawings, the coordinate systems the same as those shown in FIG. 1 are shown to indicate the relative positional relation of the elements and the directions thereof.

Figure 2:
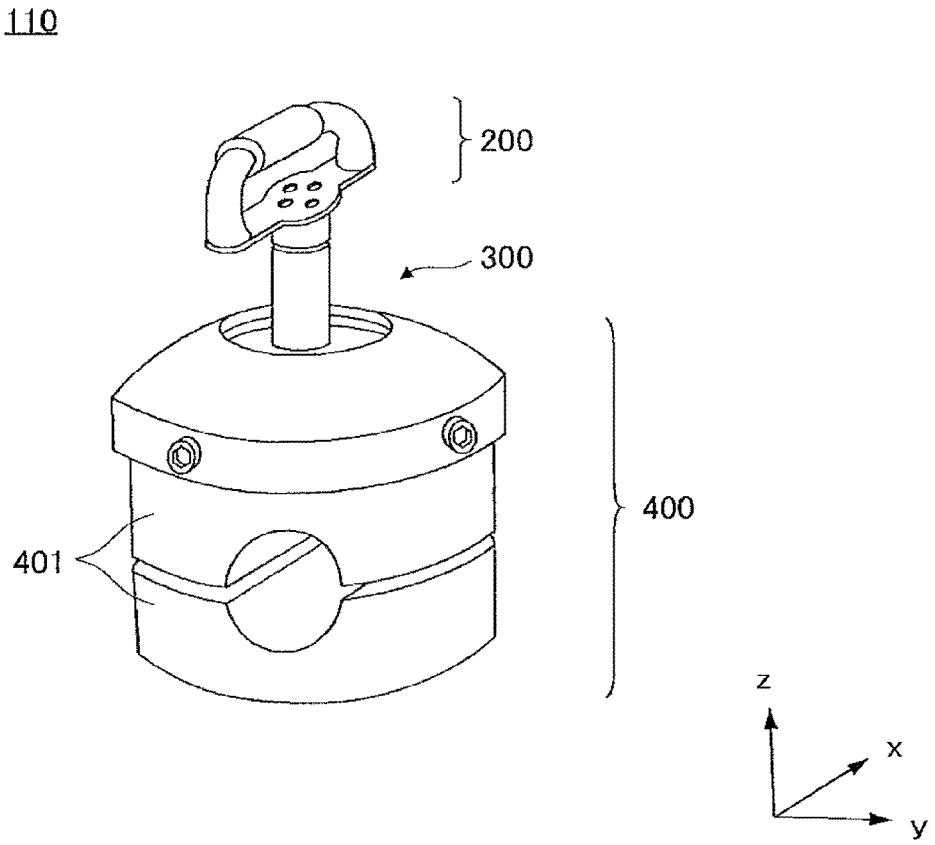
FIG. 2 is an external perspective view of an assistance stick tool.

FIG. 2 is an external perspective view of the assistance stick tool 110. The assistance stick tool 110 includes a holding part 200 that the trainee 900 holds, an immovable part 400 including a mounted part 401 mounted on the immovable part of the walking training apparatus 100, and a coupling part 300 that couples the holding part 200 and the immovable part 400. The holding part 200 is coupled to the immovable part 400 via the coupling part 300 in such a way that the holding part 200 can be relatively moved with respect to the immovable part 400. More specifically, the assistance stick tool 110 is fixed to the attachment bar 130*a* so that the holding part 200 can be moved in a direction including a component parallel to the belt 132 that serves as the walking surface. The holding part 200 can be rotated also around the z axis in such a way that the trainee 900 can easily hold the holding part 200, and FIG. 2 shows a state in which the holding part 200 is rotated by 90 degrees compared to the state shown in FIG. 1.

Figure 3:
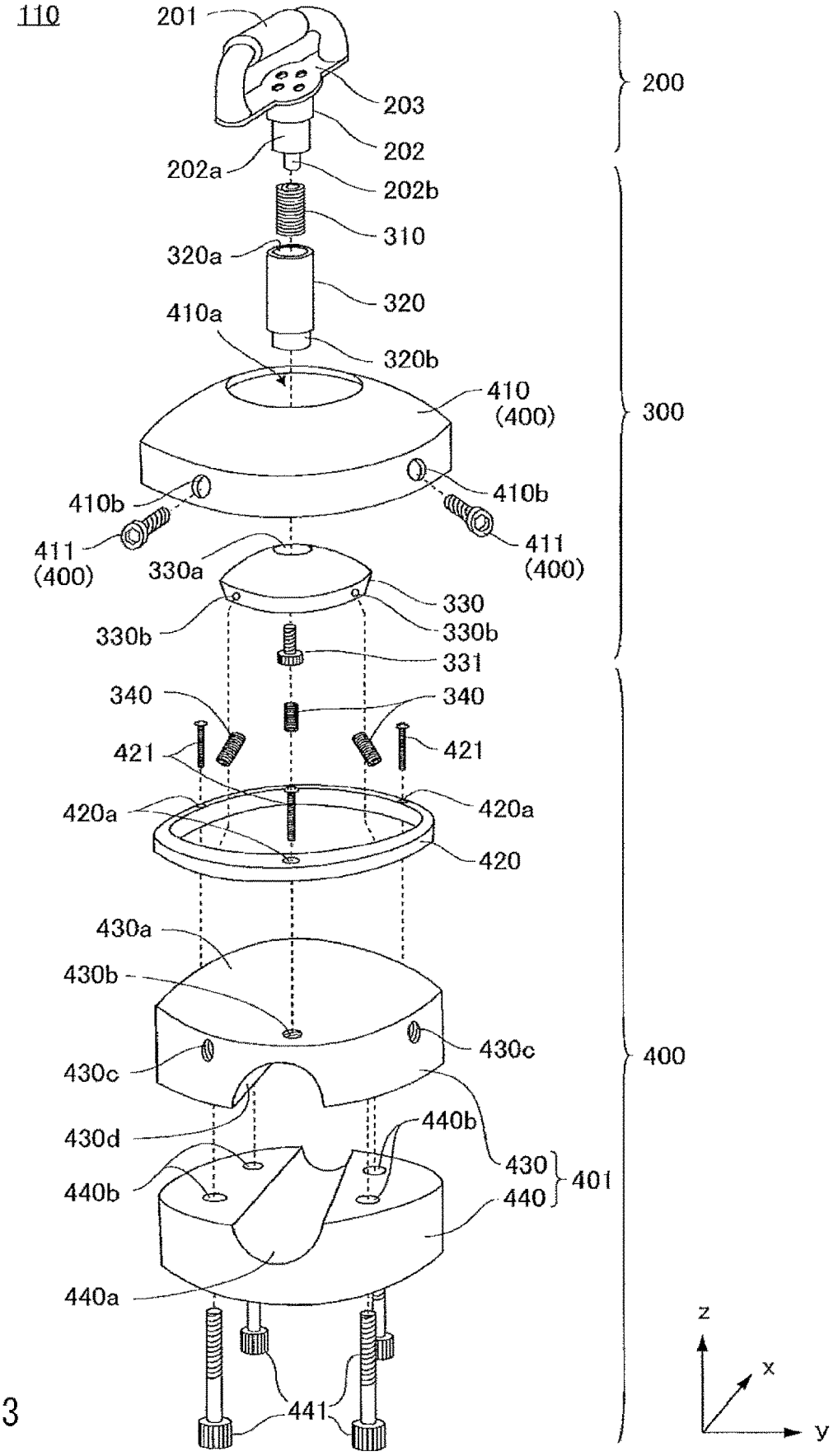
FIG. 3 is an exploded perspective view of the assistance stick tool.

A further detailed structure of the assistance stick tool 110 will be explained. FIG. 3 is an exploded perspective view of main components of the assistance stick tool 110.

The holding part 200 is mainly composed of a grip 201, a shaft 202, and a grip plate 203. The grip 201 is an element that the trainee 900 directly holds, and is, for example, C-shaped resin, with a urethane material being wound around the central part of the grip 201 so that the gripping performance can be enhanced. The grip plate 203 is a plate to which the grip 201 and the shaft 202 are attached, and is made of, for example, a stainless material. The shaft 202 is a columnar shape element that is extended in the vertical direction. The shaft 202 includes a sliding surface 202*a* that is a part of the columnar surface and is smoothly formed. Further, a lower end part of the shaft 202, which is opposite to the shaft 202's upper end part attached to the grip plate 203, is provided with a locking part 202*b* that locks one end of a coil spring 310.

The coupling part 300 is mainly composed of the coil spring 310, a shaft cylinder 320, a spherical slider 330, and a coil spring 340. The shaft cylinder 320 has an upper end side that is opposed to the shaft 202 formed to have a cylindrical shape, and a lower end side that is opposed to the spherical slider 330 formed to have a solid columnar shape. The lower end part of the shaft cylinder 320 formed to have a columnar shape has a relatively small diameter and serves as a fitting shaft 320*b*.

A locking part that locks the other end of the coil spring 310 is provided in the lower end of the shaft cylinder 320 in the cylindrical space of the shaft cylinder 320 formed to have a cylindrical shape, and the other end of the coil spring 310 is locked by the locking part. That is, the coil spring 310 has one end connected to the shaft 202 and the other end connected to the shaft cylinder 320. The coil spring 310 is accommodated in the cylindrical space of the shaft cylinder 320.

The lower end part of the shaft 202 in which the sliding surface 202*a* is provided is accommodated in the cylindrical space of the shaft cylinder 320 in such a way that the sliding surface 202*a* can be slid in contact with an inner peripheral surface 320*a* of the shaft cylinder 320 in the vertical direction. Since the shaft 202 and the shaft cylinder 320 are connected in such a way that they are attracted to each other by a contraction force of the coil spring 310, the holding part 200 is biased toward the shaft cylinder 320. The shaft 202 has a step on the upper end side of the sliding surface 202*a*, and this step interferes with the upper end surface of the shaft cylinder 320, thereby preventing the shaft 202 from being drawn into the cylindrical space of the shaft cylinder 320 for more than a defined length. The state in which the step of the shaft 202 contacts the upper end surface of the shaft cylinder 320 is a reference position of the holding part 200 in the vertical direction. Accordingly, the coil spring 310 serves as an elastic member that pulls the holding part 200 back to the reference position when the trainee 900 does not manipulate the holding part 200.

Further, the coil spring 310 has an elastic force to the extent that it is not entirely stretched with respect to the pulling motion by the trainee 900, and is able to accept a load even when an excessive load is applied in the upper side direction by the grip motion by the trainee 900. In other words, the coil spring 310 serves a function of mainly receiving the load in the vertical direction and supporting the body of the trainee 900 when the trainee 900 is likely to lose his/her balance.

The spherical slider 330 has a shallow but thick mortar shape having a top directed upward, and includes a fitting hole 330*a* that fits the fitting shaft 320*b* of the shaft cylinder 320 provided at the top of the spherical slider 330. The shaft cylinder 320 has the fitting shaft 320*b* fitted into the fitting hole 330*a* and is fixed by an attachment screw 331 from the lower surface side of the spherical slider 330, whereby the shaft cylinder 320 is integrated with the spherical slider 330. The spherical slider 330 is made of, for example, nylon resin.

The spherical slider 330 has an edge face that includes locking parts 330*b*, each of which locks one end of the coil spring 340. Three locking parts 330*b* are provided, for example, at intervals of 120 degrees. That is, three coil springs 340 are connected to the edge face of the spherical slider 330 in such a way as to extend in the radial direction.

The immovable part 400 is mainly composed of a cover 410, a spring base 420, an upper base 430, and a lower base 440. The upper base 430 and the lower base 440 serve as the mounted part 401.

The upper base 430 has an upper surface, which is one end surface of the columnar body, formed to have a spherical shape having a constant curvature radius. A slide receiving surface 430*a*, which is a surface having a spherical shape, serves as a sliding surface on which the spherical slider 330 slides. Further, the upper base 430 includes a fixing groove 430*d* having a semi-columnar shape to hold the attachment bar 131*a*, the fixing groove 430*d* being formed on the lower surface, which is the other end surface, of the columnar body. The upper base 430 is made of, for example, nylon resin.

The spring base 420 is an element that surrounds the slide receiving surface 430*a* of the upper base 430 in a ring-shaped manner in the peripheral part thereof. The spring base 420 includes screw holes 420*a* penetrating in the z-axis direction provided in the peripheral part thereof at intervals of 120 degrees. The slide receiving surface 430*a* is provided with lower holes 430*b* that correspond to the positions of the screw holes 420*a*, and the spring base 420 is fixed to the slide receiving surface 430*a* by screws 421 that penetrate the screw holes 420*a* and are screwed into the lower holes 430*b*.

The spring base 420 serves as a regulating member in the spherical direction when the spherical slider 330 slides on the slide receiving surface 430*a*. That is, even when an excessive load is applied in the outward direction of the spherical surface by the gripping motion by the trainee 900, the spring base 420 accepts the load and regulates the movement of the spherical slider 330. In other words, the spring base 420 mainly serves a function of accepting the load in the parallel direction and supporting the body of the trainee 900 when the trainee 900 is likely to lose his/her balance.

The inner peripheral surface of the spring base 420 is provided with locking parts that lock the tips of the coil springs 340 attached to the spherical slider 330. The spherical slider 330 is biased to the slide receiving surface 430*a* by the elastic force of the coil springs 340, and keeps balance at the top of the slide receiving surface 430*a* in a state in which the trainee 900 does not manipulate the holding part 200. This balanced position is a reference position of the spherical slider 330 in the spherical direction. The coil spring 340 serves as an elastic member that pulls the spherical slider 330 back to the reference position when the spherical slider 330 is moved since the holding part 200 is manipulated.

The cover 410 is a member that regulates the movement of the spherical slider 330 in the z-axis direction. The cover 410 generally has a shape that is similar to that of the upper base 430, and includes a cover opening 410*a* provided at the top of the spherical shape in such a way as not to inhibit the movement of the shaft cylinder 320 connected to the spherical slider 330. Further, the cover 410 includes screw holes 410*b* provided on the side surface thereof. The side surface of the upper base 430 is provided with lower holes 430*c* provided in positions that correspond to the screw holes 410*b*, and the cover 410 is fixed to the upper base 430 by screws 411 penetrating through the screw holes 410*b* and screwed into the lower holes 430*c*.

The cover 410 covers a part of the spherical slider 330 no matter in which position on the slide receiving surface 430*a* the spherical slider 330 is located. Therefore, even when an excessive load is applied in the upper side direction by the grip operation by the trainee 900, the cover 410 receives the load and prevents the spherical slider 330 from being pulled out. In other words, the cover 410 mainly serves a function of receiving the load in the vertical direction and supporting the body of the trainee 900 when the trainee 900 is likely to lose his/her balance.

The lower base 440 forms a columnar shape, and has an upper surface, which is one end surface, in which a fixing groove 440*a* having a semi-columnar shape for holding the attachment bar 131*a* is formed. The lower base 440 is made of, for example, nylon resin.

The lower base 440 includes four bolt holes 440*b* in such a way that they penetrate in the z-axis direction, which is an axial direction having a columnar shape. The lower surface of the upper base 430 is provided with lower holes in positions that correspond to the bolt holes 440*b*, and the lower base 440 is fixed to the upper base 430 by fixing bolts 441 that penetrate through the bolt holes 440*b* and are screwed into the lower holes. That is, since the fixing groove 430*d* of the upper base 430 and the fixing groove 440*a* of the lower base 440 are fixed to each other, with the attachment bar 131*a* held therebetween, the whole assistance stick tool 110 is fixed to the attachment bar 131*a*.

Figure 4:
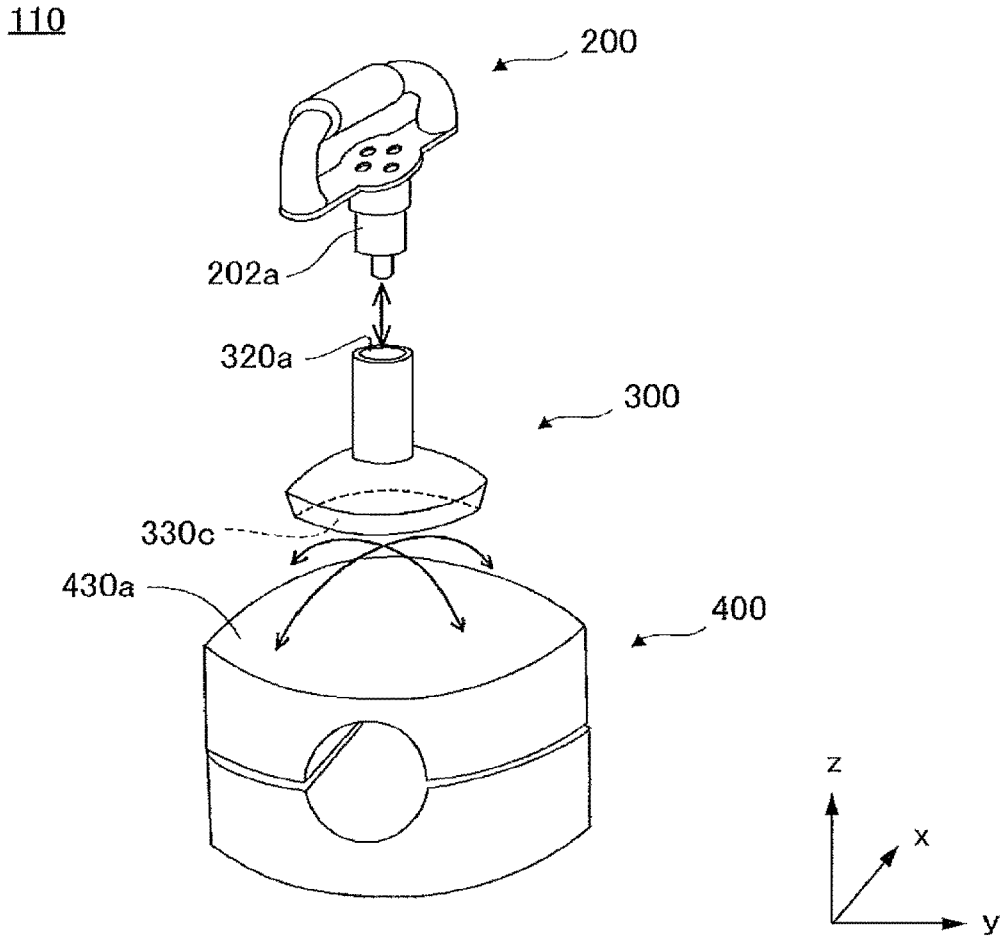
FIG. 4 is a diagram for describing a moving direction of a holding part.

Next, the moving direction of the holding part 200 will be explained. FIG. 4 is a diagram for describing the moving direction of the holding part 200. FIG. 4 is a diagram showing the relative relation among the holding part 200, the coupling part 300, and the immovable part 400 in a simple manner, some of the elements described with reference to FIG. 3 being omitted.

First, the coupling part 300 can be moved in the spherical direction since a slide surface 330*c* slides on the slide receiving surface 430*a*. The slide receiving surface 430*a* is a spherical surface that is upwardly convex, as shown in FIG. 4. In other words, the slide receiving surface 430*a* has a shape along the surface of an imaginary sphere with an imaginary point set closer to the floor surface than the holding part 200 is as a center. Accordingly, the holding part 200 connected to the coupling part 300 can be moved along the slide receiving surface 430*a*.

Then the holding part 200 can be moved in the vertical direction since the sliding surface 202*a* slides in contact with the inner peripheral surface 320*a*. To be more accurate, since the shaft cylinder 320 is installed in the spherical slider 330, the moving direction of the shaft 202 is a normal direction of the slide receiving surface 430*a* in the position of the spherical slider 330 at this time. At any rate, the holding part 200 can be moved in such a way as to include the components in the vertical direction. In this way, the movement in the spherical direction and the movement in the vertical direction are combined with each other, and the holding part 200 can be moved in a three-dimensional way in a constant space.

Figure 5:
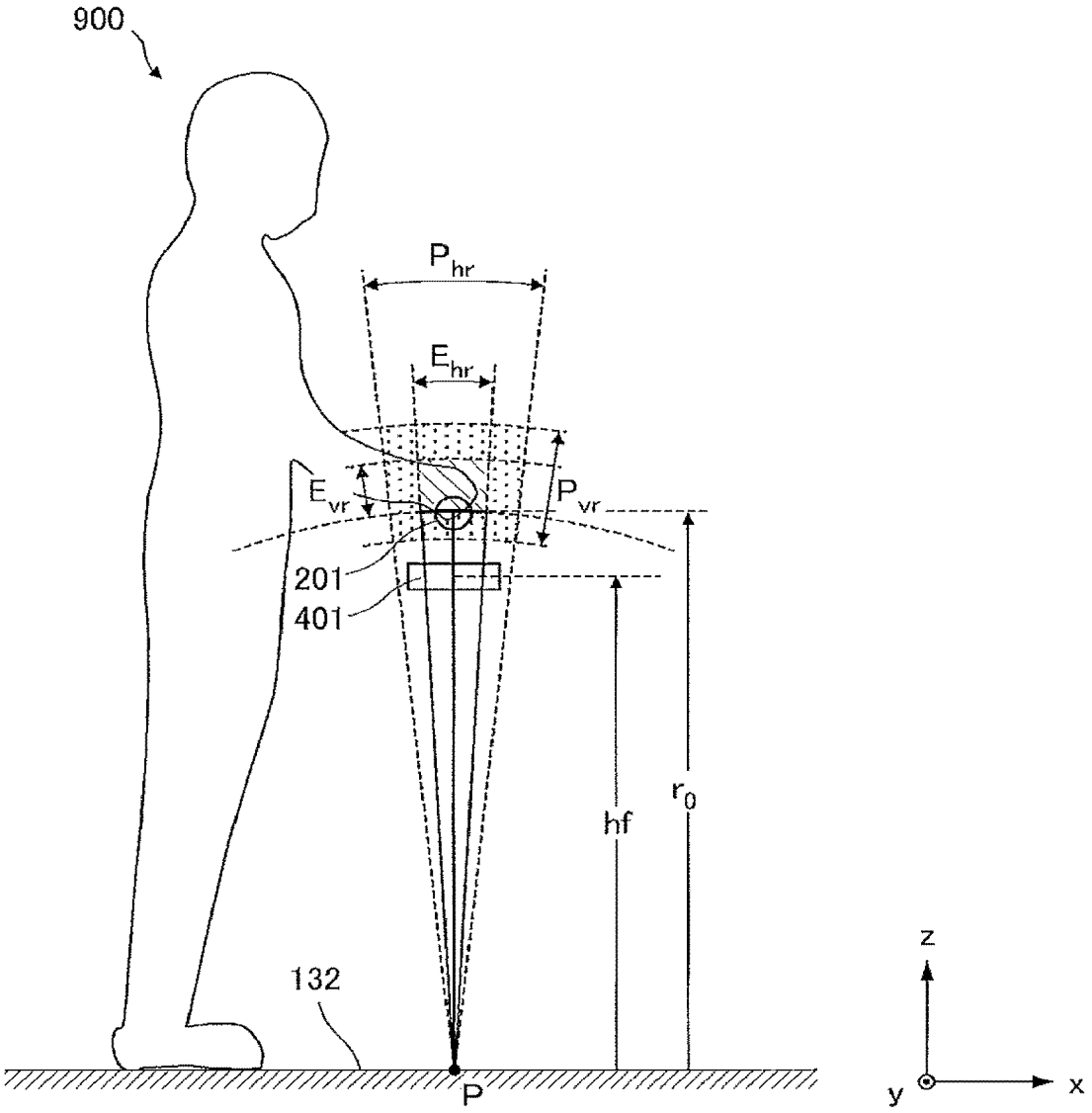
FIG. 5 is a diagram for describing a moving range of the holding part.

FIG. 5 is a diagram for describing the moving range of the holding part 200. FIG. 5 shows a state in which the trainee 900 stands on the belt 132 of the treadmill 131 and holds the grip 201 of the holding part 200.

In FIG. 5, the grip 201 is in the reference position, which is an unloaded state. In the reference position, the position at which the mounted part 401 is attached is adjusted in such a way that the trainee 900 can easily hold the grip 201. In particular, the attachment position is preferably adjusted in such a way that a point P at which the vertical line that passes the grip 201 and the walking surface of the belt 132 intersect with each other becomes the central point of the imaginary sphere in the movement of the grip 201 in the spherical direction. The curvature radius of the spherical surface in this case is, as shown in FIG. 5, $r_0$. When $r_0$ is thus defined, the movement of the grip 201 in the spherical direction substantially coincides with the movement of the holding part of the stick when the trainee 900 walks with the actual stick. Therefore, it is possible to provide a good environment for enabling the trainee 900 to move to the walking training using the actual stick.

When the assistance stick tool 110 is placed as described above, the grip 201 can swing within a range of $E_{hr}$, with the point P as a center. Further, since the grip 201 can be moved with a range of $E_{vr}$ in the vertical direction, the whole space in which the grip 201 can move is a space represented by oblique lines surrounded by the range $E_{hr}$ and the range $E_{vr}$. This space is preferably included in a range $P_{hr}$ and a range $P_{vr}$, which is a range (indicated by dots) within which the trainee 900 can move his/her arm. By regulating the moving range of the grip 201 as described above, the trainee 900 can apply his/her weight to the grip 201 when he/she is likely to lose his/her balance, whereby it becomes possible to prevent the trainee 900 from tipping over. The regulation of the moving range is achieved by the spring base 420 and the coil spring 340 supporting the load in the spherical direction and by the cover 410 and the coil spring 310 supporting the load in the vertical direction, as described with reference to FIG. 3.

Since the assistance stick tool 110 is fixed to the attachment bar 131*a*, the assistance stick tool 110 is naturally able to receive the load with which the trainee 900 presses the grip 201 in the direction of the floor surface (load applied to the walking surface) as well. The trainee 900 presses the grip 201 in the floor surface direction and applies his/her weight thereon, whereby it is possible to reduce the effort of the swinging motion or the kicking-out motion of the leg.

Figure 6:
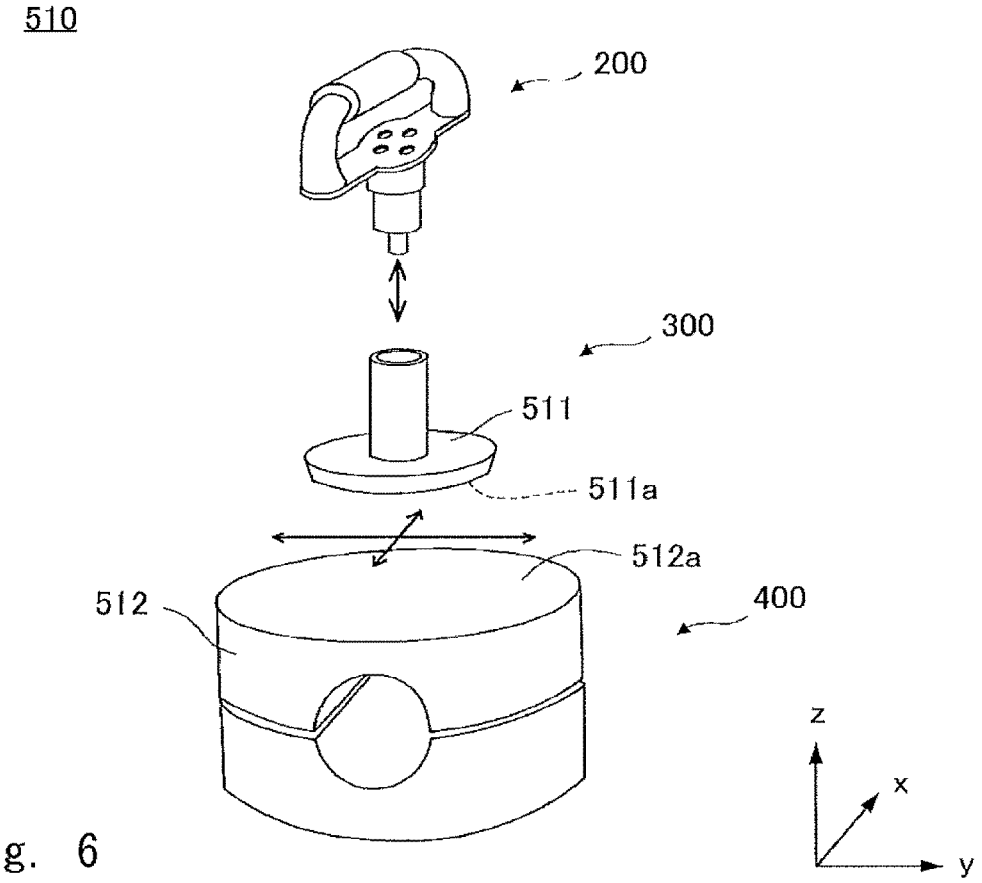
FIG. 6 is a diagram for describing a moving direction of an assistance stick tool according to another example.

Some modified examples of the assistance stick tool 110 will now be explained. FIG. 6 is a diagram for describing the moving direction of an assistance stick tool 510 according to another example. FIG. 6 is a diagram showing a relative relation among the holding part 200, the coupling part 300, and the immovable part 400 in a simple way, similar to FIG. 4. The structures of the spherical slider 330 and the upper base 430 in the assistance stick tool 510 are different from those in the assistance stick tool 110.

The assistance stick tool 510 includes a planar slider 511 in place of the spherical slider 330. The planar slider 511 has a slide surface 511*a* that has a planar shape. Further, the assistance stick tool 510 includes an upper base 512 in place of the upper base 430. A slide receiving surface 512*a*, which is an upper surface of the upper base 512, is a sliding surface on which the slide surface 511*a* slides, and has a planar shape.

That is, the holding part 200 is movable in the planar direction along the slide surface 511*a* that is perpendicular to the vertical axis. The holding part 200 can be moved in the vertical direction, similar to the assistance stick tool 110. Even with this simple structure, it is possible to reproduce the motion of the holding part of the stick when the trainee 900 walks with the actual stick to some extent.

Figure 7:
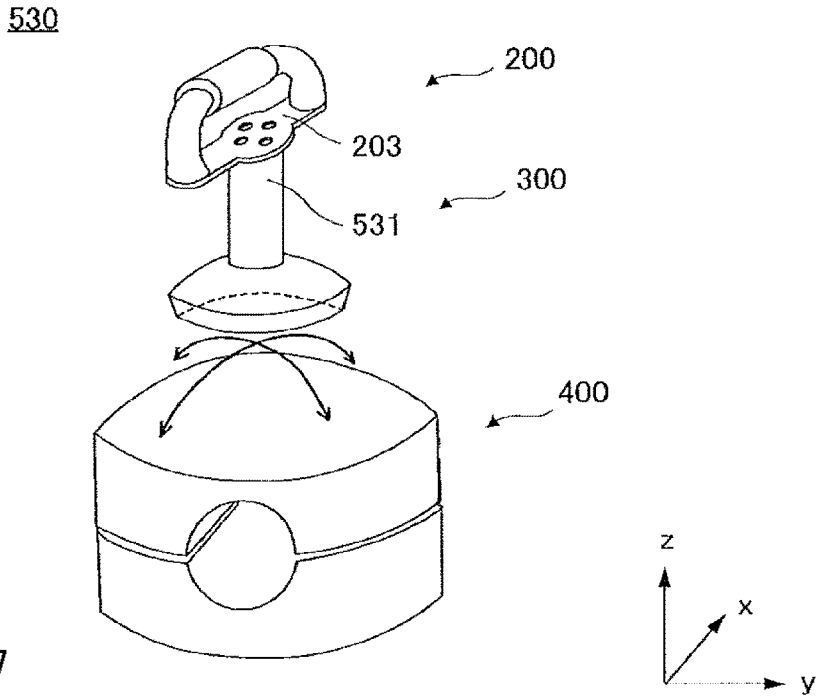
FIG. 7 is a diagram for describing a moving direction of an assistance stick tool according to another example.

FIG. 7 is a diagram for describing the moving direction of an assistance stick tool 530 according to another example.

FIG. 7 is a diagram showing the relative relation among the holding part 200, the coupling part 300, and the immovable part 400 in a simple manner, similar to FIG. 4. The assistance stick tool 530 is different from the assistance stick tool 110 in that the coupling part 300 is fixed to the holding part 200.

Specifically, a shaft cylinder 531 that corresponds to the shaft cylinder 320 in the assistance stick tool 110 is directly fixed to the grip plate 203 without the intervention of the spring coil and the like. That is, the holding part 200 is movable in the spherical direction and does not move in the vertical direction. Even with this simple structure, it is possible to reproduce the function of supporting the load in the planar direction, which is one of the functions of the actual stick.

Figure 8:
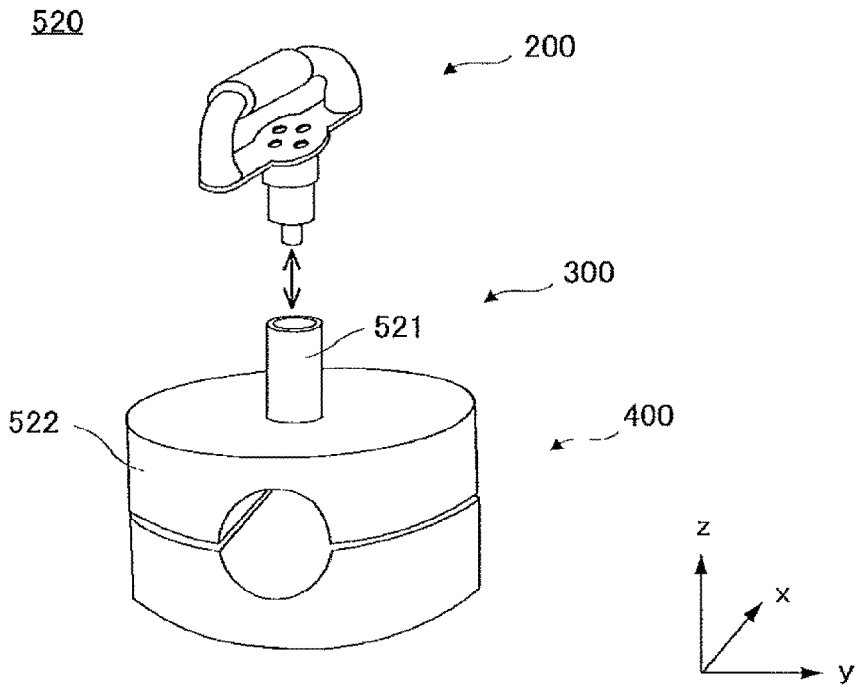
FIG. 8 is a diagram for describing a moving direction of an assistance stick tool according to another example as a reference example.

FIG. 8 is a diagram for describing the moving direction of an assistance stick tool 520 according to another example as a reference example. FIG. 8 is a diagram for showing the relative relation among the holding part 200, the coupling part 300, and the immovable part 400, similar to FIG. 4. The assistance stick tool 520 is mainly different from the assistance stick tool 110 in that the coupling part 300 is fixed to the immovable part 400.

Specifically, a shaft cylinder 521 that corresponds to the shaft cylinder 320 in the assistance stick tool 110 is fixedly installed in an upper base 522 that corresponds to the upper base 430 in the assistance stick tool 110. That is, the holding part 200 can be moved only in the vertical direction, and does not move in the spherical direction or the planar direction. Since the holding part 200 does not move in the planar direction, the trainee may have a feeling of strangeness compared to the case in which he/she uses the actual stick. However, the function of supporting the load in the vertical direction can be reproduced.

Each of the assistance stick tools described above includes a regulating member that regulates the moving range of the holding part. The regulating member may have a structure that clearly surrounds the moving range like the spring base 420, or may be an elastic member like the coil spring 310 in which the range of stretch assumed in a normal load is regulated. By providing the regulating member as described above, it is possible to add the function of supporting the load with respect to the direction in which the trainee 900 falls over, which does not exist in the actual stick. By adding this function, it can be expected that the trainee will be able to smoothly move from the training using the walking training apparatus to the training in the normal walkway. That is, since the trainee 900 is able to gradually learn the operation of manipulating the stick from the stage of the training in the walking training apparatus, it can be expected that the trainee 900 will be able to smoothly use the stick even after the trainee starts training in the normal walkway.

Further, from the viewpoint of gradually learning the manipulation of the stick, an assistance stick tool that does not regulate the moving range may be prepared in a moving space in which the trainee 900 holds the holding part. When a structure that does not actually regulate the moving range is employed, a function that is closer to that of the actual stick can be obtained. Therefore, it is preferable to perform training using the assistance stick tool that does not regulate the moving range after performing training using the assistance stick tool that regulates the moving range. However, the assistance stick tool that does not regulate the moving range is preferably formed in such a way as to be able to support the load of the holding part in the direction of the floor surface, similar to the actual stick.

Further, the assistance stick tool may be fixedly mounted on the walking training apparatus, not as a walking training assistance device that can be attached to or detached from the walking training apparatus 100. In this case, the immovable part may be provided as a part of the immovable part of the walking training apparatus 100.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A walking training apparatus comprising:

a treadmill having an infinite orbital rotation type walking surface;

a holding part that a walking trainee holds, wherein the holding part is capable of supporting a load applied to the walking surface by the walking trainee and is movable in a direction including a component parallel to the walking surface, and the walking training apparatus further comprising an elastic member that pulls the holding part back to a reference position of the movement of the holding part.

2. A walking training apparatus comprising:

a treadmill having an infinite orbital rotation type walking surface;

a holding part that a walking trainee holds;

a spherical slider connected to the holding part, the spherical slider having a spherical surface having an upwardly convex shape; and a fixing part fixed to a frame of the walking training apparatus, an upper surface of the fixing part including a slide receiving surface having a spherical shape, the spherical shape being centered about an imaginary center point that is closer to the walking surface than the holding part, wherein the holding part is capable of supporting a load applied to the walking surface by the walking trainee and is movable in a direction including a component parallel to the walking surface, and wherein the holding part is movable along a surface of the spherical shape as the spherical slider slides on the slide receiving surface.

3. The walking training apparatus according to claim 2, wherein the position of the holding part can be adjusted in such a way that the imaginary center point is positioned on the walking surface.

4. The walking training apparatus according to claim 2, wherein the holding part can be moved also in a direction perpendicular to a direction including a component parallel to the walking surface.

5. The walking training apparatus according to claim 2, comprising a regulating member configured to regulate a movable range of the holding part in such a way as to be able to support the load that the walking trainee applies to the moving direction of the holding part.

6. The walking training apparatus according to claim 2, wherein the holding part is movable in a three dimensions along the surface of the spherical shape.

7. A walking training assistance device mounted on a walking training apparatus that includes a treadmill having an infinite orbital rotation type walking surface, the walking training assistance device comprising:

a holding part that a walking trainee holds;

a spherical slider connected to the holding part, the spherical slider having a spherical surface having an upwardly convex shape; and a fixing part fixed to the walking training apparatus, an upper surface of the fixing part including a slide receiving surface having a spherical shape, the spherical shape being centered about an imaginary center point that is closer to the walking surface than the holding part, wherein the holding part is capable of supporting a load applied to the walking surface by the walking trainee and is movable in a direction including a component parallel to the walking surface when the fixing part is fixed to the walking training apparatus, and wherein the holding part is movable along a surface of the spherical shape as the spherical slider slides on the slide receiving surface.

* * * * *